United States Patent [19]

Bellagamba

[11] Patent Number: 5,024,443

[45] Date of Patent: Jun. 18, 1991

[54] ATHLETIC SWING PRACTICE APPARATUS

[76] Inventor: Miro D. Bellagamba, 5161 Vineland Rd., Orlando, Fla. 32811

[21] Appl. No.: 618,381

[22] Filed: Nov. 26, 1990

[51] Int. Cl.[5] ..... A63B 69/36; A63B 21/04; A63B 21/12

[52] U.S. Cl. ..... 273/188 R; 273/189 R; 272/139; 272/142

[58] Field of Search ..... 273/188 R, 188 A, 189 R, 273/189 A, 190 R, 190 A, 190 B, 183 B; 272/139, 142, 136, 137

[56] References Cited

U.S. PATENT DOCUMENTS

| | | | |
|---|---|---|---|
| 1,655,092 | 1/1928 | Davis | 273/189 R |
| 2,848,234 | 8/1958 | Brandon | 273/142 X |
| 4,134,589 | 1/1979 | Arena | 272/139 X |
| 4,706,957 | 11/1987 | Jackson | 273/188 R |
| 4,890,841 | 1/1990 | Brooks | 273/189 R X |

*Primary Examiner*—George J. Marlo
*Attorney, Agent, or Firm*—William M. Hobby, III

[57] ABSTRACT

An athletic swing practice apparatus combines arm swing control and upper body swing control in a single swing training system. A pair of flexible arm encircling straps are each shaped to encircle the upper arm of an athletic during a practice swing. An elastic strap extends from each of the pair of flexible arm encircling straps and each elastic strap has an elongated piece of hook and loop material attached thereto for attaching the straps together to form a single elastic strap adjustably connecting the pair of flexible arm encircling straps together by a predetermined distance. A fastener member, such as an aperture with a grommet, is attached to each of the flexible arm encircling straps and a pair of elastic cords has one cord attached to each flexible arm encircling strap through the fastening member. A pair of stationary members, such as upright poles, are attached to the earth a predetermined distance apart and each pole has openings therethrough for attaching the other end of each elastic cord thereto. Thus, a person can practice an athletic swing with each arm having the arm encircling strap thereon connected across the back of the athletic with an elastic strap to apply a predetermined force between the arms during the swing while simultaneously applying a predetermined force to the movement of the upper body by the elastic resilient cords stretched between the arm straps and the upright poles.

7 Claims, 1 Drawing Sheet

ATHLETIC SWING PRACTICE APPARATUS

BACKGROUND OF THE INVENTION

The present invention relates to an athletic swing practice apparatus and especially to a swing training device which applys a predetermined force between the arms during a swing while simultaneously providing a predetermined force to the upper body of an athlete.

In the past, it has been common to provide a great variety of swing practice systems including golf swing systems which include various types of straps for strapping the arm portions of the body to force a body in a predetermined manner during a practice swing of a golf club. Other systems strap the wrist to force the wrist to maintain certain positions during a practice swing while yet other systems guide the golf club and sometimes provide for a belt having flexible waist support cords as shown in my prior Bellagamba et al. U.S. Pat. No. 4,852,881. It has also been common in the past to provide various systems for strapping the arms or legs together to maintain them is a predetermined position during the performance of practice swings or other types of training. Typical of these prior art devices may be seen in the Promen U.S. Pat. No. 2,450,162, in which a pair of leather straps are buckled around a golfer's arms and are connected together with a metal chain and clip and the Brooks U.S. Pat. No. 4,890,841 for a golf swing aid which encircles the shoulders with an elastic band to provide directed force for the swing. In the Norman et al. U.S. Pat. No. 4,239,228 a golf swing training device has a pair of Y-shaped straps having VELCRO formed thereon so that each Y-shaped strap can be strapped around one arm of a golfer and the two strapped arms connected together by VELCRO fastener straps extending from the arms. In the Posner U.S. Pat. No. 3,324,851, an arm restraining device straps to each arm and extends across the front of a person's body while the Bell U.S. Pat. No. 4,046,143, is a heart patient aid which also has arm straps connected by a connecting link. The Davis U.S. Pat. No. 1,655,092, has a golf swing corrector having a pair of arm straps connected by an interconnecting strap across the front of the golfer. The Okerlin U.S. Pat. No. 4,377,284, is a basketball training device which straps the arms together. The Richmon U.S. Pat. No. 4,895,373, straps a golfer's body with a loop around one arm for controlling the practice swing. The Brady U.S. Pat. No. 3,680,869, is a golf training device connecting a leg strap through a flexible cord to an arm strap. The Corder, Jr. U.S. Pat. No. 4,892,317, has a golf club swing training device which straps one arm and one chest strap together with a short VELCRO strap.

The present invention utilizes arm straps as shown in some of the prior patents except the straps are connected across the back with an adjustable resilient connecting strap to apply predetermined force to the movement of the arms during a practice swing while simultaneously providing elastic cords extending from the arm straps to fixed poles to control the movement of the upper body simultaneously with the force applied to the movement of the arms to thereby provide dual forces applied to the correction of both the upper body and arm movement of a golfer or athlete during a practice swing.

SUMMARY OF THE INVENTION

An athletic swing practice apparatus combines arm swing control and upper body swing control in a single swing training system. A pair of flexible arm encircling straps are each shaped to encircle the upper arm of an athletic during a practice swing. An elastic strap extends from each of the pair of flexible arm encircling straps and each elastic strap has an elongated piece of hook and loop material attached thereto for attaching the straps together to form a single elastic strap adjustably connecting the pair of flexible arm encircling straps together by a predetermined distance. A fastener member, such as an aperture with a grommet, is attached to each of the flexible arm encircling straps and a pair of elastic cords has one cord attached to each flexible arm encircling strap through the fastening member. A pair of stationary members, such as upright poles, are attached to the earth a predetermined distance apart and each pole has openings therethrough for attaching the other end of each elastic cord thereto. Thus, a person can practice an athletic swing with each arm having the arm encircling strap thereon connected across the back of the athletic with an elastic strap to apply a predetermined force between the arms during the swing while simultaneously applying a predetermined force to the movement of the upper body by the elastic resilient cords stretched between the arm straps and the upright poles.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
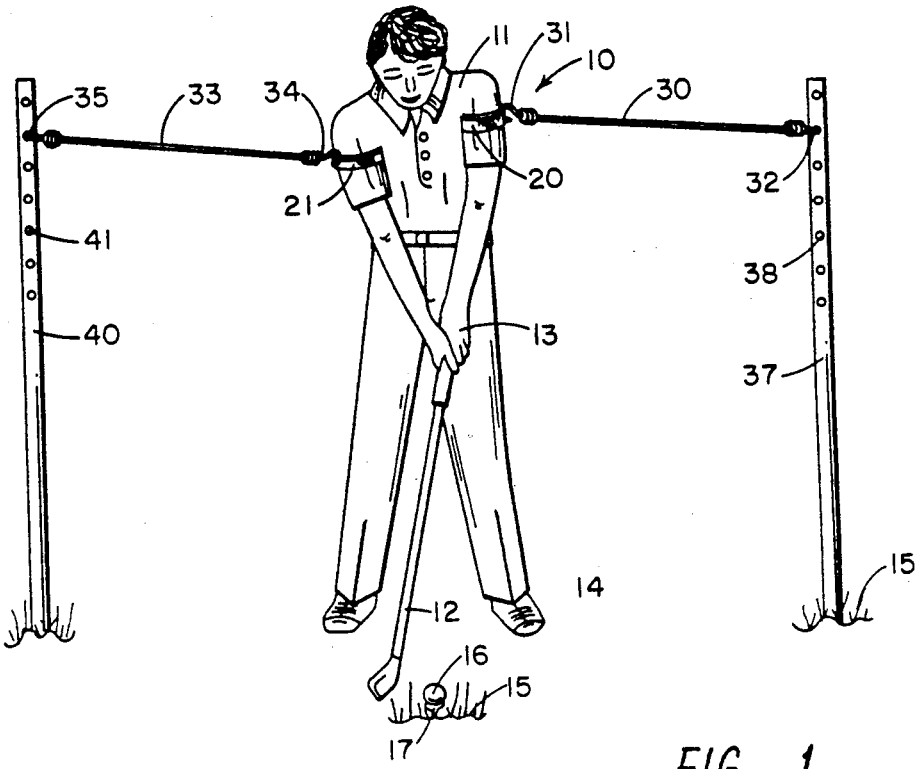
FIG. 1 is a front perspective view of an athletic swing practice apparatus in accordance with the present invention attached to a golfer during a practice swing.
Figure 2:
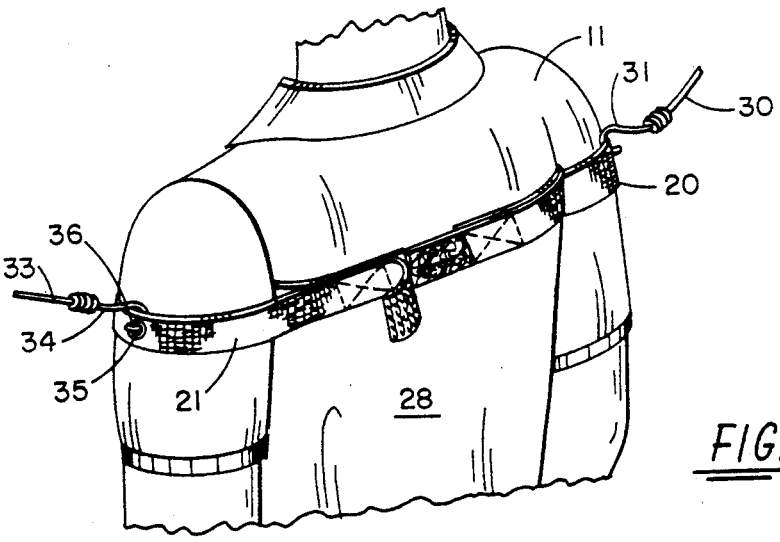
FIG. 2 is a rear elevation view of an athletic swing practice apparatus in accordance with FIG. 1.
Figure 3:
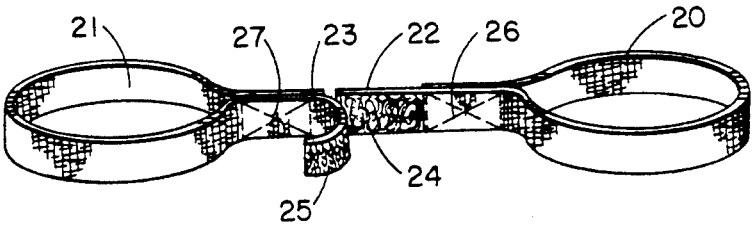
FIG. 3 is a front perspective view of an athletic swing practice apparatus in accordance with the present invention.

Referring to the drawings, FIGS. 1–3 an athletic swing practice apparatus 10 is illustrated in FIG. 1 attached to a golfer 11 practicing his swing with a golf iron 12 held in his hands 13. The golfer's feet 14 are standing adjacent a golf ball 16 in a tee 17 in the earth 15. The golfer has a swing training arm control portion shown separately in FIG. 3 having a pair of upper arm encircling straps 20 and 21, with an elastic or resilient strap member 22 extending from the arm encircling strap 20 and an elastic strap 23 extending from the arm strap 21. The strap 22 has a piece of hook and loop material or VELCRO 24 attached thereto while strap 23 has the hook material 25. The elongated hoop and loop material 24 and 25 attached to the straps 22 and 23 can be attached together and may be adjusted to vary the length between the arm loops 20 and 21 of any length desired for the individual. The strap 21 is sewn with a pair of strap members 26 extending from the arm encircling strap 20 while the extension strap 23 is sewn between a pair of flaps 27 extending from the arm encircling strap 21.

In use the loops 20 and 21 are inserted over the golfer's 11 arm, as shown in FIG. 1, with the attached elastic strap members 22 and 23 attached and extending across the back as shown in FIG. 2. Since the attached strap members 22 and 23 are elastic, they are extended across the back and place a constant force on the upper arms of the golfer 11 during any movement of the arms while swinging the golf club to apply a variable force to the arms pulling across the back 28 of the golfer.

An elastic or resilient cord 30, such as a bungee cord, has a hook member 31 on one end and a hook member 32 on the other end thereof while an elastic member 33 has a hook member 34 on one end and a hook member 35 on the other end thereof. The hook member 31 of the cord 30 is attached to the arm encircling strap 20 while the cord 33 hook 34 is attached to the arm encircling strap 21. The hooks are attached through an opening 35 having a grommet 36 placed therein so that the hooks 31 and 34 can be quickly attached to the arm encircling straps. An upright rigid pole 37 is attached in the earth 15 and may be a PVC or polymer pole having a plurality of apertures 38 extending therethrough for attaching the hook member 32 to any predetermined height desired. The elastic cord 33 has its hook 34 attached to an upright vertical pole 40 identical to the pole 37 and having a plurality of apertures 41 therethrough for receiving the hook 35. Both the elastic cords 30 and 33 are stretched and attached to the arm bands 20 and 21. They exert a force anytime the shoulder of a golfer 11 is moved with one stretching more and thus increasing the force against the shoulder while the other may be retracting and thus reducing the force applied to the other shoulder. This is being accomplished simultaneously while the stretched elastic straps 22 and 23 expand and contract responsive to the movement of the upper arms as the golfer swings the iron 12 toward a ball 16. Thus dual set of forces applied to the golfers arms and upper body tend to force the body to make a more correct swing and force him to exercise the correct muscles in making the practice swings and thus improve the golfer's swing.

It should be clear at this point that an athletic swing practice apparatus has been provided which has a variety of adjustments but places a dual set of forces on a golfer's arms and upper body which forces operate simultaneously to assist in training a golfer or other athlete with his swing. This system is however not to be construed as limited to the forms shown which are to be considered illustrative rather than restrictive.

I claim:

1. An athletic swing practice apparatus comprising:

a pair of flexible arm encircling straps shaped to encircle the upper arm of an athlete during a practice swing;

an elastic strap extending from each of said pair of flexible arm encircling straps, each elastic strap having an elongated piece of cooperating hook or loop material attached thereto for interlocking with each other and attaching elastic straps together to form a single elastic strap connecting said pair of flexible arm encircling straps together by a predetermined distance;

a fastener member attached to each of said flexible arm encircling straps;

a pair of elastic cords, each said elastic cord having a fastener member attached to one end thereof removably attaching each said cord to one said, fastener member of said flexible arm encircling, straps; and a pair of stationary members adapted to be positioned a predetermined distance apart and having means for attaching one said elastic cord to each stationary member at one end portion of each elastic cord member whereby a person can practice an athletic swing with each arm having an arm encircling strap thereon connected to each other by said pair of connected elastic straps extending across the person's back to place a predetermined force between the arms while a predetermined force is applied to the movement of the upper body during an athletic swing by said pair of elastic cords.

2. An athletic swing practice apparatus in accordance with claim 1 in which each of said stationary members are poles attachable to the earth.

3. An athletic swing practice apparatus in accordance with claim 2 in which each of said stationary members is a plastic pipe having a plurality of apertures therein.

4. An athletic swing practice apparatus in accordance with claim 3 in which said each said stationary member has a plurality of apertures therein for attaching said elastic cords in different positions thereto.

5. An athletic swing practice apparatus in accordance with claim 1 in which said each said arm encircling strap has an aperture therein for attaching one end of one said elastic cord.

6. An athletic swing practice apparatus in accordance with claim 5 in which said arm encircling strap has a grommet attached thereto around said aperture.

7. An athletic swing practice apparatus in accordance with claim 6 in which each said resilient cord has a hood member on one end thereof for connecting to said arm encircling strap grommet.

* * * * *